United States Patent [19]

Bianchi et al.

[11] 4,132,195

[45] Jan. 2, 1979

[54] METHOD AND APPARATUS FOR FUEL MIXTURE CONTROL

[75] Inventors: Valerio Bianchi, Hochdorf; Siegfried Metcher, Oberriexingen; Reinhard Latsch, Vaihingen; Hans Weidner, Schwieberdingen; Johannes Brettschneider, Ludwigsburg, all of Fed. Rep. of Germany

[73] Assignee: Robert Bosch GmbH, Stuttgart, Fed. Rep. of Germany

[21] Appl. No.: 812,037

[22] Filed: Jul. 1, 1977

[30] Foreign Application Priority Data

Jul. 17, 1976 [DE] Fed. Rep. of Germany ..... 2632319

[51] Int. Cl.[2] ..... F02B 3/00

[52] U.S. Cl. ..... 123/32 EA; 123/119 EC; 60/276; 60/285

[58] Field of Search ..... 123/32 EE, 32 EA, 140 MC, 123/32 AE, 32 EB, 119 EC, 139 BG, 140 MC, 119 E, 119 G, 139 AW; 60/274, 276, 285

[56] References Cited

U.S. PATENT DOCUMENTS

| | | | |
|---|---|---|---|
| 3,759,232 | 9/1973 | Wahl et al. | 60/274 |
| 3,822,679 | 7/1974 | Hobo et al. | 123/32 EA |
| 3,835,820 | 9/1974 | Fujisawa | 123/140 MC |
| 3,926,154 | 12/1975 | Williams | 60/276 |
| 3,931,803 | 1/1976 | Chattopadhayhay et al. | 123/139 AW |
| 3,983,856 | 10/1976 | Stumpp et al. | 123/139 AW |
| 3,993,034 | 11/1976 | Passera et al. | 123/139 AW |
| 3,994,267 | 11/1976 | Eisele et al. | 123/139 AW |
| 4,015,428 | 4/1977 | Kawai | 60/285 |
| 4,040,394 | 8/1977 | Wahl et al. | 123/119 EC |
| 4,061,055 | 12/1977 | Lizuka et al. | 123/32 EA |

*Primary Examiner*—Charles J. Myhre
*Assistant Examiner*—R. A. Nelli
*Attorney, Agent, or Firm*—Edwin E. Greigg

[57] ABSTRACT

The fuel mixture ratio of an internal combustion engine is adjusted by metering out a fuel quantity in relation to the air flow rate through the induction tube. The air flow rate is measured indirectly by monitoring the engine speed (rpm) with an electrical transducer driving a frequency-voltage converter, thus providing a first voltage, while a throttle plate position transducer generates a second voltage. The two voltages are applied to a logical circuit including parallel diodes which selects the lower of the applied signals and presents the resultant voltage as the primary control signal for fuel metering. Various compensating networks may be added to provide additional smoothing and adaptation to the operating characteristics of a particular engine and state of operation. Various fuel metering devices to be used in conjunction with the control circuit are also described.

18 Claims, 7 Drawing Figures

METHOD AND APPARATUS FOR FUEL MIXTURE CONTROL

BACKGROUND OF THE INVENTION

The invention relates to a method and an apparatus for controlling the composition of a fuel-air mixture supplied to an internal combustion engine. More particularly, the invention relates to a method and an apparatus for generating control signals from the position of the main throttle valve in the induction tube as well as from engine rpm and to use these voltages in generating a control current for actuating a fuel metering device in accordance with the requirements of the engine operation.

Customarily, the composition of the operational mixture of an engine is governed by means of a carburetor in which the venturi cross section defines a local vacuum which determines the amount of fuel delivered to the air on the basis of the pressure difference with respect to atmospheric pressure. In fuel injection systems, the air flow is generally sensed with great precision by means of air flaps and a resulting control variable is used to meter out fuel. It should be noted that both of these air and fuel metering systems can be embodied with the required precision only with substantial effort and cost.

It has also been proposed to use simply available variables, namely the engine speed (rpm) and the throttle valve position to generate a control variable which corresponds to the air flow rate at any moment and which can be used to meter out the required fuel. This method introduces the difficulty that the connection between the fuel quantity per unit time on the one hand and the throttle valve position and engine speed on the other hand is a relatively complicated function. In a known circuit for controlling fuel injection valves, a monostable multivibrator receives pulses of rpm-dependent frequency and the unstable time constant is changed in dependence on a voltage related to the throttle valve position. The unstable time constant in the circuit determines the fuel injection period. This system starts with a linear rpm dependence and is able to provide only a relatively coarse adaptation of the injection time to the characteristic curves of injection timing which are specific to a particular internal combustion engine. In another known system, there is generated a voltage which depends on the rpm and on the position of the gas pedal for adjusting the position of a three dimensional cam via electromechanical transducers. The three dimensional cam which represents the operating characteristics of the engine is then followed by a second mechanical-electrical transducer which generates a suitable control variable for influencing the final control element of a fuel injection pump. If sufficient precision is required, this latter known system is very expensive because the attainable precision is adversely affected by the several transducing steps and by the mechanical following of the cam.

OBJECT AND SUMMARY OF THE INVENTION

It is therefore a principal object of the invention to provide a method and apparatus for controlling the composition of the combustible mixture of an engine in which the given connection between the aspirated air quantity of an engine on the one hand and the rpm and throttle valve position on the other hand can be stored precisely in an electronic circuit and in relatively inexpensive manner.

It is a further object of the invention to use as electronic computer circuitry a relatively simple logical AND circuit which, in spite of being very inexpensive, permits a sufficient adaptation of the control signal to the actual conditions in which the engine operates.

Yet another object of the invention is to provide means for obtaining a linear and unfalsified translation of the control variable into a metered-out fuel quantity.

These and other objects of the invention are attained by generating an rpm-dependent voltage and a throttle valve position-dependent voltage and applying these two voltages to a logical AND circuit so as to obtain a voltage which is in turn dependent on the air flow rate through the engine. This signal is used for adjusting the composition of the fuel-air mixture by engaging an appropriate fuel metering system either as an analog signal or a derived cyclic signal. In this way, two simply measured variables are used with little expense for obtaining a precise fuel mixture control.

The invention will be better understood as well as further objects and advantages thereof become more apparent from the ensuing detailed description of preferred exemplary embodiments taken in conjunction with the drawing.

DESCRIPTION OF THE PREFERRED EMBODIMENTS

Figure 1:
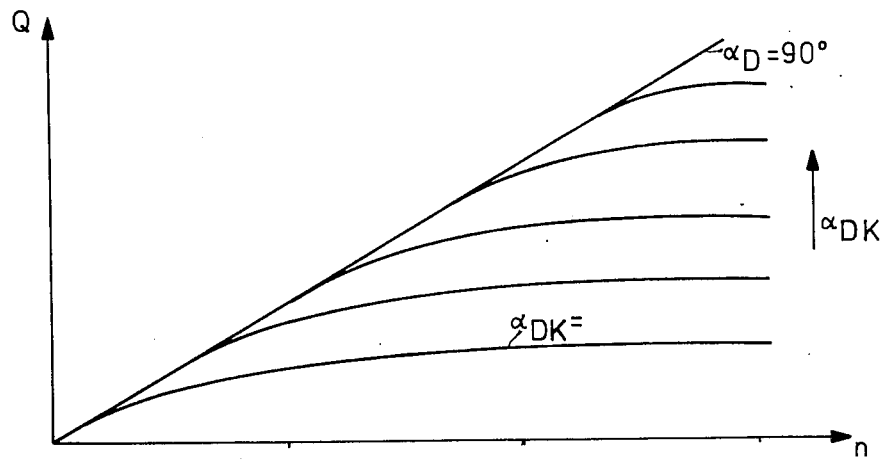
FIG. 1 is a set of curves illustrating the fuel or air quantity per unit time at constant air factor $\lambda$ as a function of rpm for various throttle valve angles.

It is well known that the quantity of combustible mixture required by an engine depends on the operational state of the engine. The operational mixture is generally obtained by measuring the air quantity aspirated per unit time and supplying thereto a requisite amount of fuel. A very precise metering of fuel is required for optimum operation especially with a view to rules and laws relating to the composition of exhaust gases. In general, a substantially stoichiometric mixture in which the air factor $\lambda = 1$ is desired. The amount of air taken in by the engine depends in the first instance on rpm and also on the throttle valve position but, in addition, depends on particular flow conditions and oscillatory states within the induction tubes of particular engines and is normally measured with the aid of mechanisms such as venturis. However, it is possible to store the characteristic curves which relate the aspirated air quantity and the engine speed and throttle valve position in a particular engine and use these data for determining the metered-out fuel quantity. A set of characteristic curves of this type is shown in FIG. 1 where there are plotted curves for constant throttle valve position $\alpha_D$ which relate the aspirated air flow rate to the requisite fuel quantity for a constant air factor λ. It will be seen that when the throttle valve angle is 90°, the functional relationship between the engine speed (rpm) and the required fuel quantity is substantially linear. It may also be observed that, beginning with a straight line at $\alpha_D = 90°$, the other curves, in which $\alpha_D$ is a constant less than 90°, become progressively more parallel to the abscissa at increasing rpm. These characteristic curves may be generated by an electronic circuit which will be explained in detail below with the aid of FIG. 2 without making direct measurements of the air flow rate through the engine. The signal finally obtained by the circuit to be described is proportional to the fuel quantity per unit time.

Figure 2:
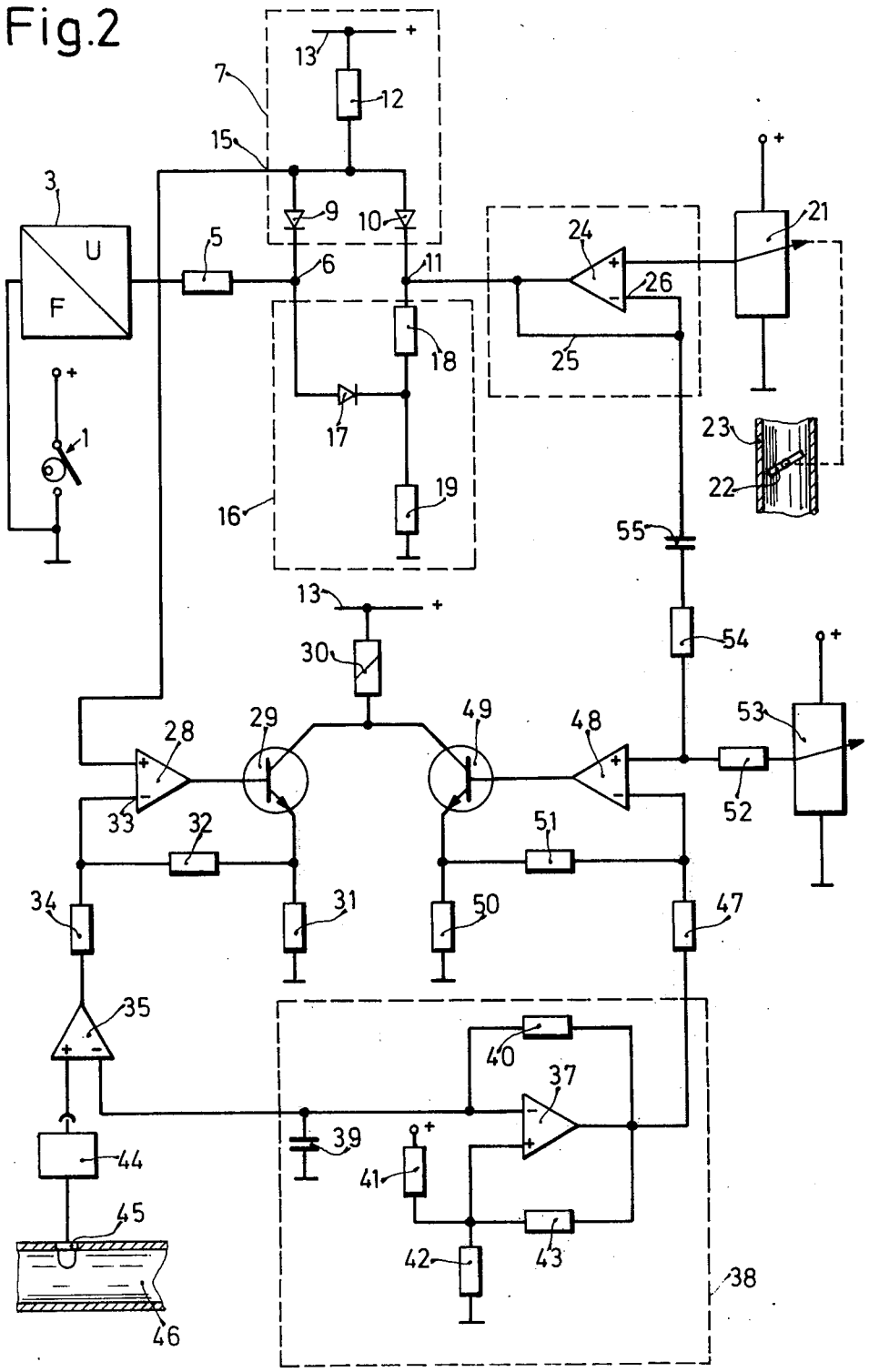
FIG. 2 is a circuit diagram of an apparatus for carrying out the method of the invention and for generating a signal related to the air flow rate and used for metering out an appropriate amount of fuel.

Turning now to FIG. 2 there will be seen the circuit diagram of an apparatus for generating curves such as illustrated in FIG. 1. The circuit includes a pulse generator 1 which is associated with a rotational member of the engine and generates a pulse train at a frequency equal to the engine speed. Such a generator may be for example the ignition distributor of the engine. The pulses generated are fed to a frequency-to-voltage transducer 3 for generating a continuous voltage proportional to the input frequency, i.e., the engine speed. The output of the F-V converter 3 is connected via a resistor 5 to an input junction 6 of a logical AND circuit defined by the dashed border 7. In known manner, the circuit 7 includes a diode 9 and a diode 10 the anodes of which are joined and connected through a common resistor 12 to the positive voltage supply line 13 of the circuit. The cathodes define inputs 6 and 11, respectively. The joined anodes represent an output junction 15.

A voltage divider consisting of series-connected resistors 18 and 19 is connected between the cathode of the diode 10 and ground. The junction of the two resistors 18 and 19 is connected through a further diode 17 to the input junction 6. The throttle valve position is transduced by a linear potentiometer 29 which provides a voltage related to the throttle valve angle and is mechanically coupled to the throttle plate 22. The throttle plate 22 rotates in a portion of the engines induction tube 23, which is not further illustrated. The potentiometer tap is connected to the non-inverting input of an impedance converter embodied as an operational amplifier 24, the output of which is connected to the throttle plate signal input point 11 and is also connected via a feedback line 25 to the inverting input 26. The voltage obtained at the output 15 is connected to the non-inverting input of a further operational amplifier 28 whose output is connected to the base of an NPN transistor 29. The collector of the transistor 29 is connected to a coil 30 which lies in series with the positive voltage supply line of the circuit while the emitter of the transistor 29 is connected to ground via an emitter resistor 31. The coil 30 is an operational part of a solenoid which is used in a mechanism to be further described below for metering out fuel in proportion to the applied signal.

The emitter of the transistor 29 is connected through a feedback path including a resistor 32 to the inverting input of the operational amplifier 28. The inverting input 33 of the operational amplifier 28 is further connected through a resistor 34 with the output of a comparator 35 also embodied as an operational amplifier. The inverting input of the comparator 35 receives a sawtooth voltage of fixed frequency while the non-inverting input receives a correcting signal. The sawtooth signal is taken from the inverting input of another operational amplifier 37 connected as a multivibrator 38. The multivibrator is constructed in know manner by connecting its inverting input 37 to a capacitor 39 which is grounded and to connect it further through a resistor 40 to its output thereby providing a feedback path. The non-inverting input of the operational amplifier 37 is connected to a voltage divider consisting of resistors 41 and 42 and via a resistor 43 to the output. The inverting input of the operational amplifier 35 receives a control signal which in this particular embodiment is shown to be the output signal of a control circuit 44 which receives the signal of a known oxygen sensor 45 located in an exhaust channel 46 of the engine and uses it to provide an appropriate control signal. A control circuit 44 which may be used is described for example in U.S. Pat. No. 3,903,853.

The output of the operational amplifier 37 is connected via a resistor 47 to the inverting input of a further operational amplifier 48 whose output is connected to the base of a second NPN transistor 49. The collector of the transistor 49 is also connected to the coil 30 in parallel with that of the transistor 29. The emitter of the transistor 49 is connected through a resistor 50 to ground and through a resistor 51 to its inverting input, thereby closing the feedback path of the operational amplifier 48. The non-inverting input of the operational amplifier 48 receives a voltage from a potentiometer 53 through a resistor 52 and is also connected through a resistor 54 and a series-connected capacitor 55 to the inverting input 26 of the previously described operational amplifier 24.

Figure 3:
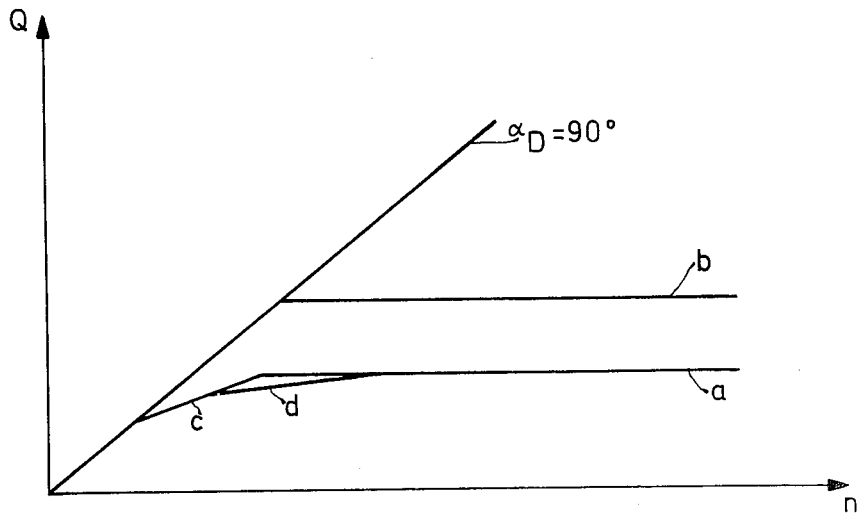
FIG. 3 is a set of curves illustrating the behavior of the parameters as obtained by the circuit in FIG. 2.

The circuit described above operates as follows. The signal from the pulse generator 1 which may be, for example, an inductive pulse generator of known construction, is fed to the rpm input 6 through the resistor 5. Depending on the angular position of the throttle valve 22 and the consequent displacement of the potentiometer 21, the input junction 11 receives a voltage related to the throttle valve position. In known manner, the voltage at the junction 15 follows the smaller of the two voltages present at inputs 6 and 11 respectively. In a chosen throttle valve position, one may therefore obtain the curve labeled "a" in FIG. 3. Beginning at a very low rpm, the rpm voltage signal is smaller than the throttle valve voltage so that the increase of the voltage at the junction 15 at first follows the approximate straight line $\alpha_D = 90°$ with increasing rpm. As soon as the voltage at the junction 6 is equal in magnitude to that at the junction 11, and for any subsequent increase in rpm, i.e., an increase of the rpm-dependent voltage, the output voltage 15 follows the voltage at the input 11. During any further rpm increase and for a fixed throttle valve position, no change in the voltage takes place. If the throttle valve opening is greater, one obtains a curve "b" parallel to the curve "a". In this manner a coarse adaptation of the signal to the family of curves $\alpha_D$ = constant of FIG. 1 is obtained.

In order to obtain an adaptation to the actual curves of FIG. 1 in the transition region between the proportional voltage increase obtained by the logical AND circuit 7 and the domain of constant voltage during further rpm increases, there is provided a network 16 consisting of the voltage divider resistors 18 and 19, a diode 17 and the resistor 5. The voltage divider resistors 18 and 19 define a voltage which is stepped down from that present at the throttle valve input 11. As soon as the voltage at the input contact 6 is larger than this stepped-down voltage, the diode 17 begins to conduct. If the frequency-dependent voltage is further increased, the voltage at the output contact 15 no longer follows the proportional curve $\alpha_D = 90°$ but follows instead a curve of lesser slope defined by the ratios of the resistors 5, 18 and 19. In this manner the input 6 reaches the level of the input 11 only at a higher rpm. The curve obtained in this manner is labeled "c" in FIG. 3. The point at which the curve "c" branches off from the curve $\alpha_D$ is determined by the ratio of the voltage dividing resistors.

A further degree of adaptation to the actual curves may be obtained by connecting other parallel diode-resistor networks similar to that of the network 16. In this manner one may obtain the portion of the curve "d" within the curve "a". Thus the characteristic family of curves of FIG. 1 is seen to be capable of simulation with considerable precision. The voltage occurring at the contact 15 is then used in proportionality to the metered-out fuel quantity.

The fuel metering is performed by metering system which includes a coil 30 which is part of the final control element of the fuel metering system. The coil 30 is actuated by rectangular pulses generated by a multivibrator 38 which feeds the inverting input of the operational amplifier 48. Accordingly, the transistor 49 conducts cyclically and a pulsating current flows over its collector emitter path through the coil 30. Superimposed thereon is a constant current defined by the voltage present at the non-inverting input of the operational amplifier 48. Thus the total current through the coil 30 due to the operational amplifier 48 is a pulsating current the constant component of which is raised by a specific amount as long as the voltage at the non-inverting input of the operational amplifier remains constant. This voltage may be used for adjusting the idling state by means of the potentiometer 53. As is well known, the inverting input of an operational amplifier connected as a multivibrator exhibits a triangular voltage of constant frequency. Based on this triangular voltage and the correcting signal applied to the non-inverting input of the operational amplifier 35, the input 33 of the amplifier 28 receives a rectangular voltage of constant frequency and of a pulse width which varies according to the correcting signal. Here too, the operational amplifier 28 determines the current flowing through the transistor 29. As already described with respect to the transistor 49, a pulsating current flows through the coil 30 and the collector-emitter path of the transistor 29. This pulsating current is raised by a constant component according to the voltage applied to the inverting input of the operational amplifier 28.

Thus the total current flowing through the coil 30 is composed of a first uniformly pulsating current and a second current which also pulses but which varies according to the output signal at the circuit point 15 and due to a control influence. In the illustrated example, the control influence is due to a circuit 44 which processes signals of an oxygen sensor but the invention is not limited to this example and any suitable control signal related to exhaust gas composition may be applied to the non-inverting input of the comparator 35. Such a signal may be, for example, from an engine roughness controller. However, yet other parameters of the engine may be used, for example the engine temperature, etc., for purposes of correction. The circuit of FIG. 2 further includes an RC member to improve the dynamic operation of the circuit. This RC member consists of a capacitor 55 connected in series with a resistor 54 between the inverting input of the amplifier 24 and the non-inverting input of the amplifier 48. If the throttle plate 22 changes position and the inverting input 26 of the amplifier 24 experiences a suddenly increasing or decreasing voltage, the voltage at the non-inverting input of the amplifier 48 is changed for a short period of time in such a manner as to also change the collector current flowing through the coil 30 in the same sense as the throttle valve position change.

It will be appreciated that the circuit illustrated in FIG. 2 and described above represents merely a preferred exemplary embodiment. The final control element of a fuel metering system may also be addressed in some other way based on the output voltage at the point 15 of the logical AND circuit 7. For example, a known circuit may generate a pulse train of constant frequency and use the voltage at the point 15 for changing the pulse width This derived signal may then be used for actuating electromagnetic injection valves. The cycling frequency must be chosen large enough so that even when the engine runs at full rpm, each cylinder receives fuel at least once for each set of cycles. Instead of addressing a final control element in cyclic manner, for example by means of the coil 30, it would be possible to provide a final control element which responds to analog control on the basis of the voltage at the point 15 of the AND circuit 7. Pulsating, i.e., cyclic control is preferred, however, if mechanical hysteresis due to friction is to be prevented.

Figure 4:
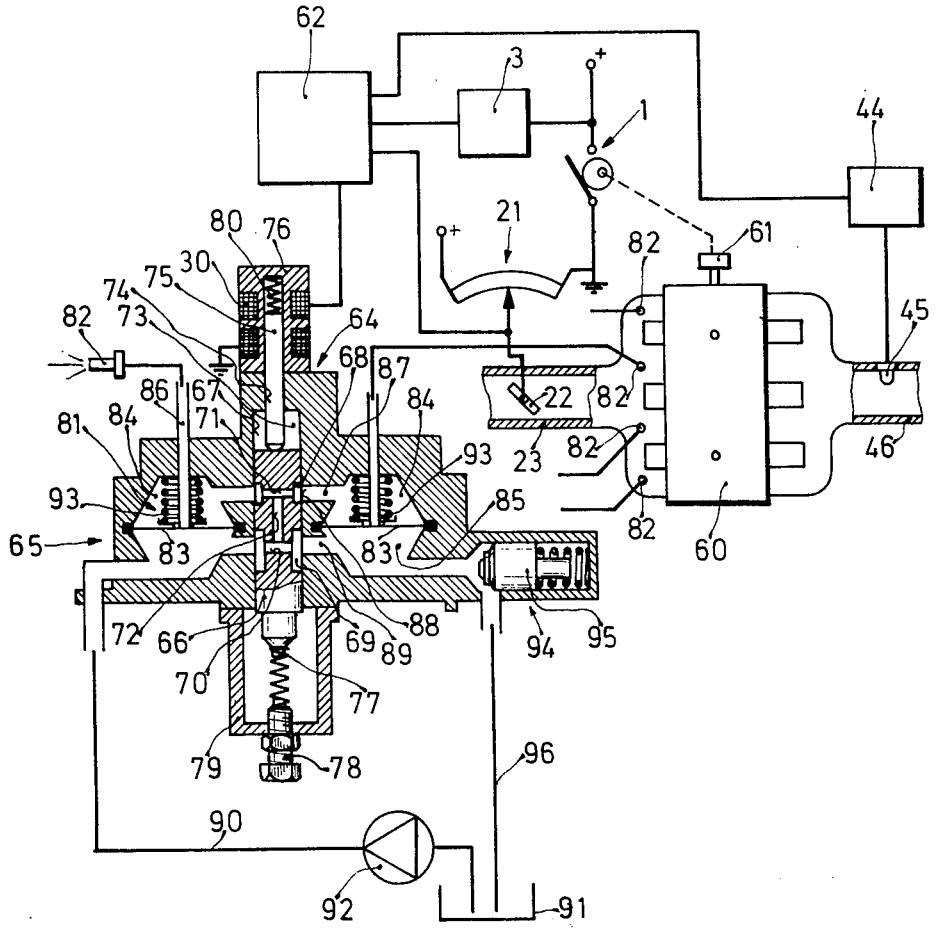
FIG. 4 is a partially sectional and partially schematic illustration of a first exemplary embodiment of a fuel metering device controlled by the apparatus of FIG. 2.

The fuel metering system which may be used in association with the circuit described so far is embodied in a first variant in FIG. 4. In that embodiment, there is shown an internal combustion engine 6 with an exhaust system 46 and an induction tube 23. The induction tube contains a throttle valve 22 which is coupled to the linear potentiometer 21. Associated with the crankshaft 61 is the pulse generator 1 which may be for example a part of the ignition distributor of the engine. As described with respect to FIG. 2, the pulse generator is connected to the frequency-to-voltage converter 3 the output of which leads to a control circuit 62 described in detail above in connection with FIG. 2. This circuit 62 is shown as a symbolic box in FIG. 4 and it receives the signal from the potentiometer 21 and from the correcting circuit 44 which receives its information from an oxygen sensor 45 in the exhaust system 46. The output of the circuit 62 is connected to the coil 30 which is part of the final control element 64 of a fuel metering system 65. The fuel metering device 65 may be a known mechanism including a metering piston 66 which is sealingly guided in a bore 67 and which has an upper annular groove 68 and a lower annular groove 69 which communicate through radial bores 70 and 71 as well as through an axial bore 72. In the blind bore 67, the metering piston 66 defines a space 73 into which extends an actuating pin 75 which is guided in a bore 74 which is coaxial with the bore 67. The actuating pin is the armature of a solenoid 76 which is used as the final control element 64 and which employs the previously mentioned coil 30 to provide an actuating magnetic field. The solenoid further includes a return spring 77 which engages the piston at its opposite end and which is supported on a set screw 78 in a bracket 79 coupled to the housing of the metering system. A relatively weak holding spring 80 also acts on the metering piston 66 via the pin 75.

The fuel metering system 75 further includes differential pressure valves 81 the number of which corresponds to the number of fuel injection locations 82 in the induction tube and which are located around the metering piston 66. Each of the differential pressure valves includes a diaphragm 83 which defines a control chamber 84 and a reference chamber 85. The control chamber receives the terminus of an injection line 86 coupled to an injection location 82 which is the valve seat whose opening is adjusted by the position of the diaphragm 83. The control chamber also includes a compression spring 93 tending to open the valve seat. A bore 87 connects each of the control chambers 84 in the individual differential pressure valves 81 with the cylindrical bore 67 and defines fuel metering apertures 88 the cross section of which can be altered by the lower edge of the upper annular groove 68 depending on the axial position of the metering piston 66. The reference chambers 85 of the various differential pressure valves 81 are in constant communication via bores 89 extending radially from the bore 67 and the lower annular groove 69. Fuel is supplied to the reference chambers 85 via a fuel line 90 coming from a fuel supply pump 92 which pumps fuel from a fuel container 91. A pressure control valve 94 in parallel with the pump 92 regulates the return flow of fuel through a return line 96 with the aid of a spring loaded piston 95. The pressure control valve 94 thus maintains a constant fuel pressure in the reference chambers 85 and this pressure is communicated through the lower annular groove 69 and the axial bore 72 to the metering apertures 88. The operation of the just described fuel metering system is as follows. Depending on the degree of actuation of the coil 30 by the circuit 62, a pulsating current of variable magnitude flows through the coil and results in an appropriate displacement of the actuating pin 75. As a result, the metering piston 66 and thus the free aperture of the metering openings 88 is adjusted. The differential pressure valves 81 always maintain a constant pressure difference across each of the metering openings and this differential pressure is determined substantially by the tension of the compression springs 93 and the constant reference pressure. Thus the quantity of fuel is metered out only in dependence on the axial position of the piston 66 and not on any of the pressure conditions prevailing at the injection locations 82. If the metering apertures 88 are suitably dimensioned, it is possible to obtain a linear dependence of the fuel quantity supplied to the various injection lines on the axial displacement of the metering piston 66. It is also possible to so construct the magnet 76 as to obtain a linear displacement of the metering piston 66 as a function of the control voltage at the point 15 of the logical AND circuit.

Inasmuch as the end face of the metering piston 66 is exposed to atmospheric pressure as well as to the force of the spring 77, the metering system is provided with an adjustment which responds to the altitude of operation. An altitude adjustment can also be provided by a barometric device connected ahead of the spring 77. The idling position may be adjusted by means of the set screw 78. An advantage of the construction of the present embodiment is that the metering piston 66 is pushed into its topmost position in which the metering apertures 88 are closed whenever the current through the coil 30 fails. Only when the current through the coil 30 increases is the metering piston 66 displaced downwardly and according to the voltage present at the output 15 of the AND circuit 7 so that an increasing cross section of the metering apertures 88 is opened.

Figure 5:
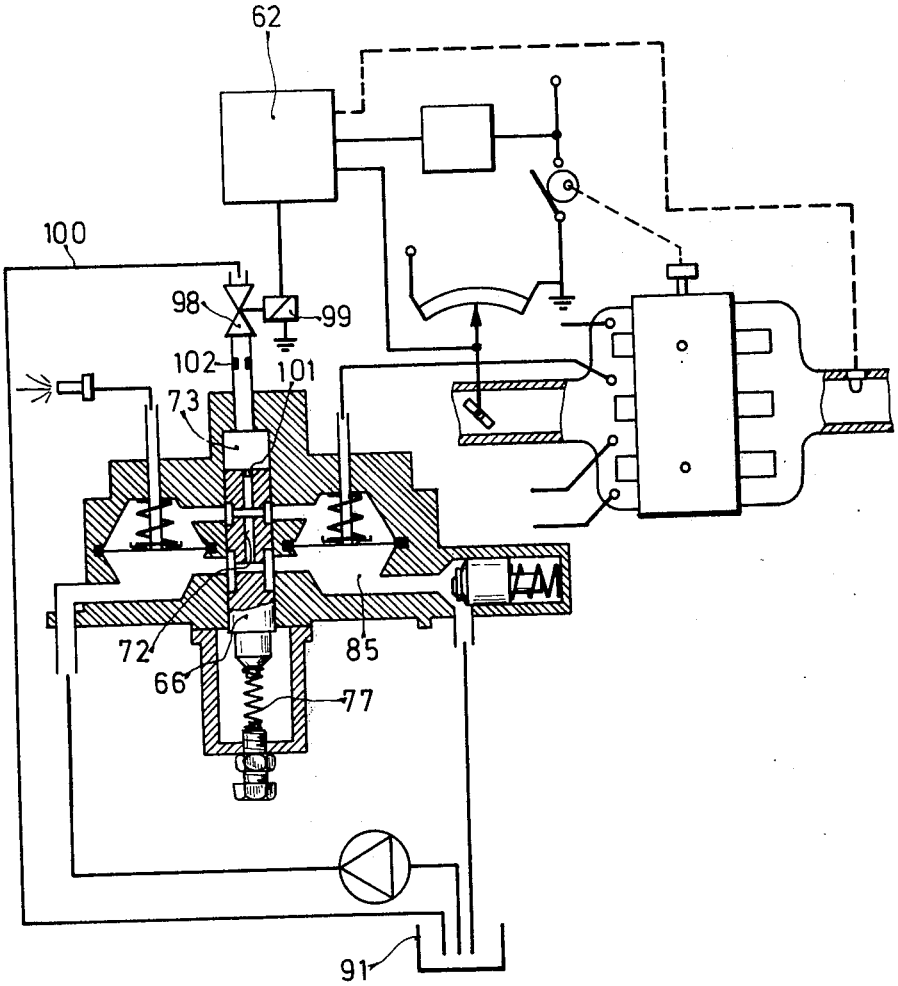
FIG. 5 is a second exemplary embodiment of a fuel metering device controlled by the apparatus of FIG. 2.

A second embodiment of a fuel metering device which may be used under the control of the circuit of FIG. 2 is illustrated in FIG. 5. In most respects the apparatus of FIG. 5 is similar to that of FIG. 4 and identical parts will retain the same reference numerals. Their description may be obtained from the foregoing example. The embodiment of FIG. 5 differs from the previous example by the provision of a magnetic valve 98 with a coil 99 controlled by the circuit 62. The magnetic valve 98 lies in a return line 100 leading back to the fuel container 91. The line 100 is connected to the chamber 73 defined at the top of the metering piston 66 and this chamber 73 is constantly connected via a throttle 101 with the axial bore 72 and hence with the reference chambers 85. Located between the electromagnetic valve 98 and the space 73 is an adaptation throttle 102 for those cases in which the valve is cyclically actuated. The actuation signal, as already described, is based on the control voltage at the output contact 15 of the logical AND circuit and is transformed in known manner into a pulse train having constant frequency and variable pulse width depending on the control voltage.

However the electromagnetic valve 98 may also be controlled by using the circuit 62 to modulate the control signal in which its coil 99 is equivalent to the coil 30 of FIG. 2.

Depending on the actuation of the electromagnetic valve 98, the pressure in the chamber 73 is altered. The pressurized fluid displaces the metering piston 66 to varying degrees in the direction of the spring 77 and thus changes the flow cross section through the apertures 88.

Figure 6:
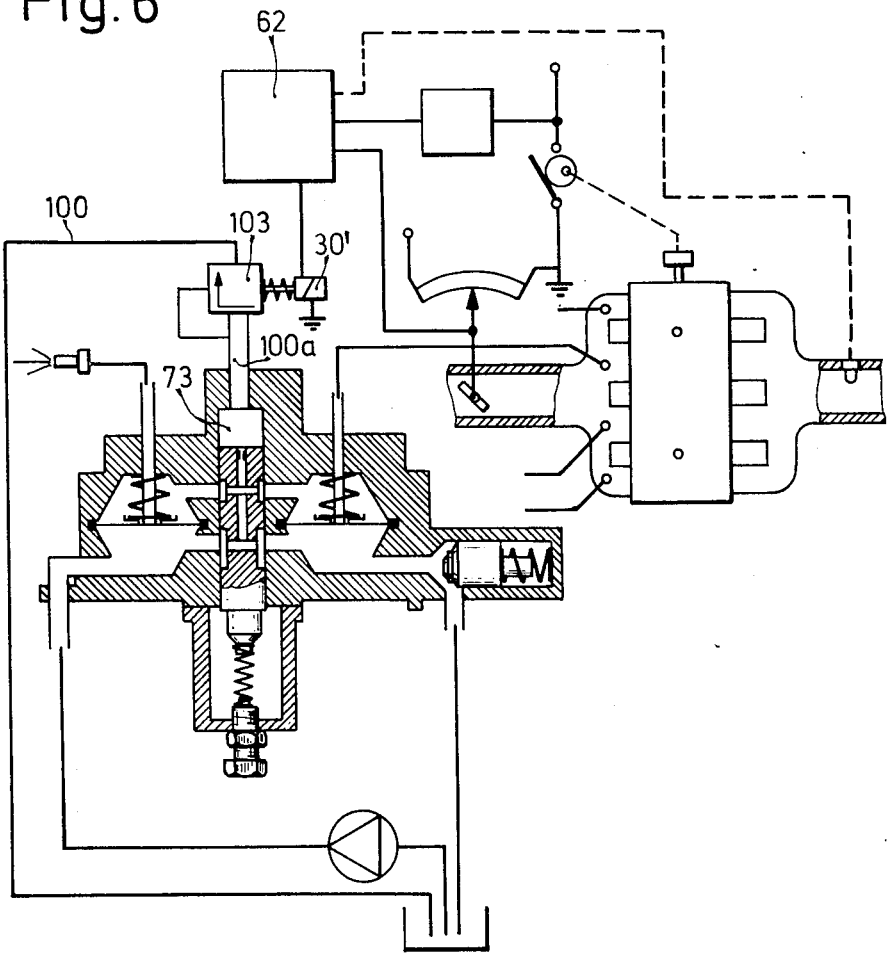
FIG. 6 is a third exemplary embodiment of a fuel metering device controlled by the apparatus of FIG. 2.

A third embodiment of the fuel metering system to be used with the control circuit 62 is illustrated in FIG. 6. This example is substantially similar to that of FIG. 5 except for the insertion of a pressure controller 103 to take the place of the electromagnetic valve 98 in the return line 100. In this case, the previously described throttle 102 is not present because the pressure controller itself provides the required throttling. This pressure controller 103 is actuated by the circuit 62 in a manner similar to that described in the exemplary embodiment of FIG. 4 by passing through a coil 30' a pulsating current superimposed on a constant current of a magnitude depending on the control signal at the output 15 of the AND circuit 7.

Figure 7:
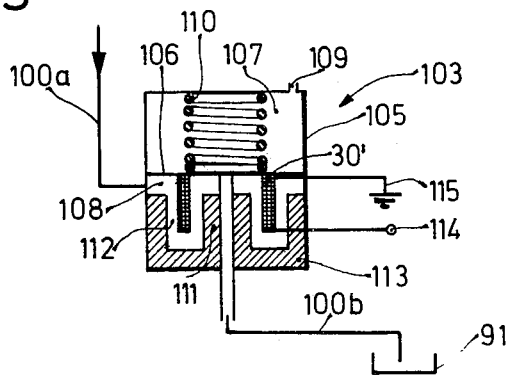
FIG. 7 is a detailed illustration of the pressure controller in the third exemplary embodiment according to FIG. 6.

FIG. 7 illustrates the pressure controller 103 of FIG. 6 in detail. In this exemplary case, the pressure controller includes a pressure cell 105 in which a diaphragm 106 defines a reference chamber 107 and a pressure chamber 108. The reference chamber has a relief bore 109 and a compression spring 110 which urges the diaphragm 106 to close a valve seat provided at the terminus of a line 100*b* extending into the pressure chamber 108. The pressure chamber 108 is always connected through a conduit 100*a* belonging to the return line 100 with the chamber 73. The conduit 100*b* connects the pressure chamber 108 with the fuel container 91. The terminus of the line 100*b* and thus the flow cross section is determined by the diaphragm 106. On the side of the pressure chamber 108, the coil 30' is fixedly attached to the diaphragm. This coil enters an annular depression 112 of an annular magnet 113 which constitutes the bottom of the pressure cell. The annular depression provides a magnetic core 111 which is concentric with the coil 30′ and which receives the concentric partial conduit 100*b* of the return line 100. The magnetic core 111 and the coil 30′ are embodied to preferably provide a setting magnet having linear characteristics. Electrical lines 114 and 115 connect the coils to the circuit 62 and ground.

The foregoing construction permits an adjustment of the force exerted on the diaphragm in addition to that of the spring 110. Depending on the magnitude of the current which passes through the coil 30′, the diaphragm 106 is lifted from the terminus of the conduit 100*b* in opposition to the force of the spring 110 at a relatively higher or lower pressure in the pressure chamber 108. Thus depending on the current through the coil, there is obtained in the pressure chamber 108 and hence also in the chamber 73 a variable fuel pressure. The metering piston 66 is displaced by this variable pressure in a manner described in connection with FIG. 5. Instead of employing the above-described pressure control valve, it is also possible to use a pressure control valve of different construction which may be engaged electromagnetically. A significant aspect of the various pressure controllers is that the pressure in the chamber 73 is made linearly dependent on the control voltage present at the output 15 of the logical AND circuit 7. If a pressure controller is used and if a piston is employed instead of the diaphragm 106, it is advantageous to employ a pulsating control for the coil 30′ in order to prevent one sided frictional effects and undesirable hysteresis.

The method and the various embodiments of the apparatus described above make possible a sufficiently precise control of the composition of a fuel-air mixture of an engine in relatively simple manner. A particular advantage of the method and apparatus of the invention is to make unnecessary a separate air flow metering device. This omission not only results in reduction of cost but provides the additional advantage that the throttling losses in the induction system of the engine are kept low, resulting in a relative increase of power. It is further possible to provide multiplicative adjustment depending on the exhaust gas composition or the engine roughness. Inasmuch as the control voltage at the output of the logical AND circuit 7 is proportional to the fuel quantity (if a constant air factor $\lambda$ is assumed) this control voltage may be used advantageously for a direct indication of the fuel consumption per unit time. A known dividing device may be employed to provide an indication of the fuel consumption in liters per 100 kilometers or miles per gallon.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. An apparatus for controlling the fuel-to-air ratio of the combustible mixture for an internal combustion engine, said engine including an induction tube, an air throttle valve contained in said induction tube and a fuel metering system for providing fuel to the air admitted through said induction tube, and wherein the improvement comprises:

means for generating a first electrical analog signal related to the degree of opening of said air throttle valve;

means for generating a second electrical analog signal related to the actual engine speed (rpm);

electronic circuit means for receiving said first and second electrical analog signals and for generating therefrom an analog output datum equal to the smaller of said first and second analog signals; and means for coupling said analog output datum to said fuel metering system;

whereby the fuel-to-air ratio of said combustible mixture provided to said engine is set to predetermined values.

2. An apparatus as defined by claim 1, wherein said electronic circuit means includes two diodes, the anodes of said diodes being joined and constituting the output contact from said circuit means and wherein the cathode of one diode receives said first electrical analog signal and the cathode of said second diode receives said second electrical analog signal and a secondary network including a third diode for correcting said output datum according to the characteristics of said internal combustion engine.

3. An apparatus as defined by claim 2, wherein the secondary network consists of two resistors connected between the contact receiving said first electrical analog signal and circuit ground and wherein the junction of said resistors is connected to the cathode of said third diode the anode of which is connected to the contact receiving said second electrical analog signal and further comprising a resistor between said means for generating said second electrical analog signal and said contact receiving said second electrical analog signal.

4. An apparatus as defined by claim 3, wherein said means for coupling said output datum to said fuel metering system includes a control pulse generator for generating pulses of constant frequency and voltage dependent width.

5. An apparatus as defined by claim 4, wherein said fuel metering system comprises electromagnetically actuated injection valves controlled by electric pulses.

6. An apparatus as defined by claim 1, wherein said fuel metering system includes a fuel quantity distributor having a central metering piston sliding in a bore, said metering piston being axially displaced by a variable hydraulic pressure and having a control edge cooperating with apertures provided in the wall of said bore to thereby alter the free flow cross section through said apertures in dependence on the axial position of said metering piston, and comprising fuel injection lines connected to said apertures, said fuel injection lines being connected to fuel injection valves located in the induction tube regions of said engine, and further comprising a differential pressure valve associated with each of said fuel injection lines, each of said differential pressure valves having a reference chamber coupled to a source of constant fuel pressure and a control chamber including a spring loaded diaphragm, said diaphragm cooperating with the terminus of said fuel injection line in the manner of a valve, said apparatus further comprising a calibrating spring for providing an axial return force on said metering piston.

7. An apparatus as defined by claim 6, wherein said metering piston is provided with an annular groove the edge of which adjacent said calibrating spring cooperates with said apertures to provide said control function and wherein said annular groove is connected through an axial bore in said metering piston with a second annular groove constantly communicating with said reference chamber and wherein the inoperative position of said fuel metering device is one wherein said metering piston closes said apertures by means of said control edge.

8. An apparatus as defined by claim 6, further comprising electromagnetic means for causing axial displacement of said metering piston.

9. An apparatus as defined by claim 6, further comprising an electromagnet for displacing said metering piston, the axial displacement of said metering piston being proportional to the power applied to said electromagnet.

10. An apparatus as defined by claim 1, wherein said metering piston and the bore receiving said metering piston together define a closed space connected to a source of constant pressure and further comprising pressure control means for modifying the pressure in said closed space by electrical actuation.

11. An apparatus as defined by claim 10, wherein said pressure control device includes an electromagnetically actuated valve.

12. An apparatus as defined by claim 11, further comprising throttling means between a central bore and said metering piston and said closed space and second throttling means between said closed space and the source of pressurized fuel.

13. An apparatus as defined by claim 12, wherein the axial bore in said metering piston is connected to said reference chamber which acts as a source of pressurized fuel.

14. An apparatus as defined by claim 6, wherein said metering piston and said bore receiving said metering piston defines a closed space connected to a source of constant pressure and pressure control means for modifying said constant pressure by electrical actuation and wherein said pressure control means is a pressure regulator including a linear magnet and a control spring, said linear magnet being actuated by the output datum from said electronic circuit means.

15. An apparatus as defined by claim 14, further comprising means associated with the exhaust gas system of said engine for generating a signal related to the exhaust gas composition, said exhaust gas related signal being superimposed on said output datum from said electronic circuit means.

16. An apparatus as defined by claim 15, wherein said means associated with the exhaust system includes an oxygen sensor for signal generation.

17. An apparatus as defined by claim 1, further comprising means for sensing the operating roughness of the engine and for generating a third signal superimposed on the output datum of said electronic circuit means.

18. An apparatus as defined by claim 1, further comprising arithmetic circuit means for receiving said output datum from said electronic circuit means connected to visual indicator means for providing a visible indication of the actual fuel consumption rate of said engine.

* * * * *